US006243082B1

(12) United States Patent
Konishi

(10) Patent No.: US 6,243,082 B1
(45) **Date of Patent: *Jun. 5, 2001**

(54) APPARATUS AND METHOD FOR VISUAL DISPLAY OF IMAGES

(75) Inventor: Morikazu Konishi, Kanagawa (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/825,802

(22) Filed: Apr. 2, 1997

(30) Foreign Application Priority Data

| | | |
|---|---|---|
| Apr. 4, 1996 | (JP) | 8-082905 |
| Apr. 8, 1996 | (JP) | 8-085211 |
| Feb. 24, 1997 | (JP) | 9-039247 |

(51) Int. Cl.[7] ..... G09G 5/00
(52) U.S. Cl. ..... 345/204; 345/55; 345/82
(58) Field of Search ..... 345/55, 56, 82, 345/30, 33–39, 40, 44, 46, 48, 204, 214, 903; 340/701, 767, 782, 793

(56) References Cited

U.S. PATENT DOCUMENTS

| | | | | |
|---|---|---|---|---|
| 5,184,114 | * | 2/1993 | Brown | 340/701 |
| 5,525,873 | * | 6/1996 | Lambert et al. | 315/366 |

* cited by examiner

*Primary Examiner*—Bipin Shalwala
*Assistant Examiner*—Jimmy H. Nguyen
(74) *Attorney, Agent, or Firm*—Sonnenschein, Nath & Rosenthal

(57) ABSTRACT

A low-power, less electromagnetic noise, and inexpensive display apparatus and a display method used in this apparatus are disclosed. During a frame period, an image-signal extracting circuit extracts a pixel signal Vext corresponding to a given pixel from an image signal Vd forming a frame image. The extracted pixel signal Vext is then stored in a memory cell unit during the frame period. Subsequently, the pixel signal Vext stored in the memory cell unit is read during the frame period. A display device corresponding to the read pixel signal Vext is excited for a predetermined duration of the frame period.

12 Claims, 13 Drawing Sheets

APPARATUS AND METHOD FOR VISUAL DISPLAY OF IMAGES

BACKGROUND OF THE INVENTION

1. Field of the Invention

The present invention includes a display apparatus and a display method and, more particularly, a flat panel display apparatus and a flat panel display method. The invention is also concerned with a display apparatus constructed of a plurality of display devices disposed in the same vertical plane, suitable for a display panel for displaying characters, graphics, patterns, etc. Further, the invention pertains to a display method used in this type of display apparatus.

2. Description of the Related Art

Display apparatuses, such as display panels, can be categorized into large-sized display apparatuses for outdoor use, such as displays for traffic signs, guide signs, public relations, advertisement, time, date, etc., and small and medium-sized display apparatuses, such as monitors for machines used in offices, such as personal computers and word processors, and vehicle-loaded display panels. One type of such a known display apparatus is constructed using electro-optical conversion devices as display devices.

The display apparatuses of this electro-optical conversion type include flat panel display apparatuses and solid-state pixel display apparatuses, such as liquid crystal displays (LCD), plasma display panels (PDP), and electroluminescence displays (ELD). The flat panel display apparatus is constructed of a plurality of very minute display devices disposed in a plane in a two-dimensional matrix form and are operable according to the following dot sequential driving method. Only the very minute display devices located at the activated rows and columns are driven for a short period of time, and such activated rows and columns are sequentially shifted to adjacent display devices, which are then driven for a short period of time. This operation can be continuously repeated to form an image with a minimal number of drivers.

According to this method, the individual display devices are sequentially driven in a time-division manner. Accordingly, one display device forming each pixel is activated only for a short period of time allocated in a time-division manner to perform a display operation by means such as emitting light. Then, after a lapse of a certain period of given time, the light goes off.

FIG. 18 is a block diagram of the above conventional type of flat panel display apparatus. FIG. 19 is a chart illustrating an image signal input into the flat panel display apparatus shown in FIG. 18. An explanation will now be given of the known flat panel display apparatus with reference to FIGS. 18 and 19.

A flat panel display apparatus generally indicated by 51 has a pixel matrix 52, a high-frequency gate driver 53 and a high-frequency signal driver 54, both of which select one of the display devices arranged in rows and columns forming the pixel matrix 52 and excite the selected device, and a controller 55 to supply a display signal to both the drivers 53 and 54.

Input into the controller 55 are an image signal Vd and horizontal/vertical synchronizing signals. The image signal Vd is formed of pixel signals arranged, as illustrated in FIG. 19, in the order of a column, row, and frame in a chronological order. FIG. 19 shows that one frame image is constituted of 14 columns and 16 rows. For example, if a first frame image is represented as shown in FIG. 3, the image signal positioned at the fifth row and fourth column is on, while the adjacent image signal located at the fifth row and fifth column is off. Then, if a second frame image is indicated as illustrated in FIG. 5, the image signal located at the fifth row and fourth column is turned off, while the adjacent image signal at the fifth row and fifth column is turned on.

The image signal Vd, which is modulated by the pixel signals of all the pixels arranged in matrix form, as noted above, has a high frequency ranging from several MHz to several dozens of MHz. Hitherto, images are displayed in such a manner that the high-frequency gate driver 53 and the high-frequency signal driver 54 send output signals to the individual display devices and drive them based on an input high-frequency image signal.

Since the frequency of the image signal rises to as high as several dozens of MHz, the individual display devices are turned on or off in a very short period of time, i.e., the excitation (for example, luminous) period for each display device is extremely short. Accordingly, it is necessary that both the drivers 53 and 54 activate or inactivate a relatively large drive current in a short period of time.

This aspect will be described in greater detail. For example, in a SVGA-specification driver LSI, driving at lower voltages as low as 3.3 V is being promoted due to electromagnetic noise caused by a high-frequency signal input into the driver LSI.

Further, as terminals are mounted on only one side of a panel in response to a higher-definition panel and a narrower-framed module, a driving operation is inevitably performed by using only one side of the panel, thereby increasing the frequency of a signal into the driver LSI. More specifically, although a driving operation is conventionally performed by use of comb-like terminals extended from both upper and lower sides of a panel, all the terminals are now formed only on the upper side of a panel. This makes it possible to reduce the frame area by an amount equal to the lower side of the panel. Because of the construction of a single-sided-driving display apparatus, nearly half of the frame area can be reduced, but on the other hand, the increased frequency band increases the burden on the driver. Additionally, the dot clock speed should be increased in order to achieve high resolution.

The input frequency of a VGA-specification (640 by 480 pixels) single-sided-driving TFT panel having a 26-cm diagonal dimension (10.4 model), which is the mainstream of notebook personal computers, is as high as 25 MHz. Further, the input frequency of a SVGA-specification (800 by 600 pixels) single-sided-driving TFT panel is even as high as 40 MHz, which sharply increases electromagnetic noise. If a XGA-specification (1024 by 768 pixels) single-sided-driving TFT panel is employed, the input frequency even reaches as high as 65 MHz, thereby further increasing electromagnetic noise, causing a serious problem. As a consequence, some measures must be taken in the overall drive circuit of a liquid crystal panel, for example, a smoothly formed input waveform is implemented, to reduce electromagnetic noise.

Another type of conventional display apparatus, which is an electro-mechanical type, has been developed or proposed. As an example of the above type of apparatus, a large-sized display apparatus for outdoor use or a medium-sized display apparatus, such as the one disclosed in Japanese Patent Publication No. 57-31147, is proposed. This display apparatus is constructed, as shown in FIG. 20, in the following manner. A cage-like rotary display unit 151 formed of a synthetic resin material has side faces 152 and 153 opposedly facing each other on which display surfaces of different colors, for example, red and white, are formed. This display unit 151 is rotated by a motor 154 so as to position either of the side faces 151 or 152 on the upper side of FIG. 20 in response to the on or off state of pixels, so that the red or white color can be visually recognized.

Moreover, a small-sized display apparatus, such as the one disclosed in Japanese Patent Publication No. 61-58835, is configured, as shown in FIG. 21, in the following manner. A movable segment 61 provided for part of a rotatable permanent magnet 62 masks a colored display plate 60 in accordance with the rotation of the permanent magnet 62. Accordingly, desired numerical and characters can be displayed by an unmasked portion of the display plate 60. The permanent magnet 62 is rotated by magnetization of an electromagnet 64 achieved by supplying power to a magnetization coil 63.

More specifically, the electromagnet 64 is magnetized by a current pulse flowing in the magnetization coil 63. The electromagnet 64 is magnetized with polarity, i.e., S or N, in the same direction as the current pulse supplied to the magnetization coil 63. Thus, the magnetized electromagnet 64 attracts one end of the permanent magnet 62 with the opposite polarity and repels the other end with the same polarity. The electromagnet 62 is rotated in this manner.

As is clearly seen from the foregoing description, the following image reproducing method is employed in the aforedescribed known electro-optical conversion-type flat panel display apparatuses, such as display apparatuses serving as monitors for machines used in offices, for example, personal computers, word processors, etc. That is, images are expressed by causing pixels on a display to emit light in response to an image signal of several MHz or by covering or uncovering backlight. Accordingly, power consumption required for luminous pixels is increased in response to the increased number of pixels necessitated by a larger screen and higher definition. This hampers the implementation of lower-powered display apparatuses, which are indispensable for portable terminals, such as the personal digital assistance (PDA).

Also, higher-frequency drive signals produce various adverse influences on peripheral circuits, such as occurrence of electromagnetic noise. Further, a wide-band high-frequency driver circuit with high output for switching signals on or off at a high frequency is required, thereby increasing power consumption. This causes increased cost, as well as application restrictions of such a display apparatus for portable terminals. Additionally, inexpensive display devices, such as those with slow response to high speed, may not be readily used in higher-speed display apparatuses.

The electro-mechanical type display apparatus also presents the following problems. Graphics and character patterns are formed in this type of apparatus in the following manner as described above. A rotary display unit has two different-colored display surfaces disposed with respect to a plane including a rotation axis, and the display unit is rotated so that either of the colored display surfaces can be positioned to be recognizable. With this construction, a power supply is unnecessary for such a display apparatus as long as the stable display state is maintained, and thus, power saving can be enhanced in this apparatus as compared with an electro-optical conversion-type display apparatus. Accordingly, this electro-mechanical type display apparatus is suitable for large-sized clocks and for outdoor use, such as in a stadium, for displaying scores and the lapse of time. On the other hand, additional components, such as a rotation mechanism and a motor, are required, resulting in an enlarged apparatus. Additionally, it is difficult to shorten the time required for a rotating operation, thereby decreasing the response speed.

Moreover, the following problem is encountered by a display apparatus developed as a monitor for machines used in offices, such as personal computers and word processors, which is constructed to form images in the following manner. An activated or inactivated pixel signal is supplied to a magnetization coil to magnetize an electromagnet, which further attracts or repels a permanent magnet to rotate it. In response to this rotation, a segment provided for the magnet is moved to cover or uncover a display plate. Additional components, such as a rotation mechanism, are also required for this type of apparatus, thereby increasing the size and cost of the apparatus. In addition to various inconveniences, such as a short lifetime and breakdowns, caused by the rotation mechanism, it is hard to shorten the time required for a rotating operation, thereby decreasing the response speed.

SUMMARY OF THE INVENTION

Accordingly, the present invention work toward providing a flat panel display apparatus and a flat panel display method inhibiting electromagnetic noise, free from the above-described problems, in which cost reduction and low power consumption are achieved by using a low-frequency (narrow band) and low-output driver circuit, and cost reduction is further attained by using display devices having low-response characteristics.

The present invention works towards providing a low-power, high-speed, small-sized, fault-resistant, long-life and inexpensive display apparatus and a display method used in such an apparatus.

According to one aspect of the present invention, there is provided a flat panel display method in which a picture is formed by sequentially and continuously displaying a plurality of frame images during respective frame periods in a time sequential order, each of the frame images being formed by sequentially displaying a plurality of pixels arranged in a matrix form in a time-division manner during a frame period, the method comprising the steps of: extracting a signal corresponding to a given pixel from an image signal forming the frame image during the frame period; storing the extracted pixel signal in a memory device during the frame period; reading the pixel signal stored in the memory device during the frame period; and exciting the pixel corresponding to the read pixel signal for a predetermined duration of the frame period.

According to another aspect of the present invention, there is provided a flat panel display apparatus comprising: a plurality of display devices forming pixels arranged in a matrix; a pixel-signal extracting circuit for extracting a signal corresponding to a given pixel from a high-frequency image signal; a memory device for storing the extracted pixel signal; a driver for sequentially supplying a drive current to electrodes of the respective display devices for a predetermined duration of a frame period based on the pixel signal read from the memory device; and a controller for controlling reading and writing from and to the memory device.

According to still another aspect of the present invention, there is provided a flat panel display apparatus comprising: a plurality of display devices forming pixels arranged in a matrix; a pixel-signal extracting circuit for extracting a signal corresponding to a given pixel from a high-frequency image signal; a plurality of memory devices which are capable of recording, in a time sequential order, a plurality of pixel signals respectively extracted from a plurality of frame images arranged in a time sequential order; a delay circuit for sequentially supplying read signals to the plurality of memory devices with a time lag; and a driver for sequentially supplying a drive current to electrodes of the respective display devices based on the pixel signals read from the memory devices.

According to a further aspect of the present invention, there is provided a display apparatus comprising: a transparent or translucent display plate; a plurality of display devices each with a flat top surface, disposed in the proximity of a surface of the display plate to be movable until it is brought into contact with the display plate; and a moving mechanism for independently moving the display devices directly or indirectly to bring them into contact with the surface of the display plate in accordance with the on or off state of an image signal.

According to a yet further aspect of the present invention, there is provided a display apparatus comprising: a transparent or translucent display plate; an upper magnetic strip with an opening at least at its central portion, embedded in the vicinity of the reverse surface of the display plate; a base member disposed away from the reverse surface of the display plate with a predetermined spacing; a lower magnetic strip embedded in the vicinity of the obverse surface of the base member; a coil, disposed between the display plate and the base member, being capable of generating an induction magnetic field in the upward or downward direction by an energized magnetization current; a magnetization circuit which is capable of supplying the magnetization current to the coil, the direction of the magnetization current being reversible; and a plurality of display devices, each with a flat top surface, comprising a permanent magnet disposed within the coil to be movable until it is brought into contact with the display plate, wherein an attractive force between the display device and the upper or lower magnetic strip is made larger than a gravitational force upon the display device, and a force for attracting the display device due to the induction magnetic field generated by the coil is made larger than the attractive force between the display device and the upper or lower magnetic strip.

According to a further aspect of the present invention, there is provided a display apparatus comprising: a transparent or translucent display plate; a base member disposed away from the reverse surface of the display plate with a predetermined spacing; a permanent magnet or a magnetic strip embedded in the base member; a coil, disposed between the display plate and the base member, being capable of generating an induction magnetic field in the upward direction by an energized magnetization current; and a plurality of display devices each with a flat top surface, comprising a permanent magnet disposed within the coil to be movable until it is brought into contact with the display plate.

According to a further aspect of the present invention, there is provided a display method in which pixels are switched on or off in accordance with a state in which a colored top surface of a display device is brought into contact with the reverse surface, serving as an irregular reflection surface, of a transparent or translucent display plate, or a state in which the top surface of the display device separates from the reverse surface of the display plate.

In the flat panel display method of the present invention, a signal corresponding to a given pixel is extracted from an image signal forming a frame image. The extracted pixel signal is stored in a memory device during a frame period, and the stored pixel signal is then read from the memory device during the same frame period. The pixel corresponding to the read pixel signal is excited for a predetermined duration of the frame period. Accordingly, the signal frequency is significantly reduced, thereby achieving low power consumption. Further, the pixel associated with the read pixel signal may continue to be excited until the end of the frame period or extending to a subsequent frame period. This further makes it possible to lower the signal frequency and also improve screen flicker.

According to one form of the flat panel display apparatus of the present invention, a signal corresponding to a given pixel is extracted from a high-frequency image signal by the pixel-signal extracting circuit. This extracted pixel signal is stored in a memory device and immediately read from the memory device. The driver then supplies a drive current to the corresponding display device based on the read pixel signal, and the device is excited to display an image. With this construction, the signal frequency can be vastly reduced, thereby implementing low power consumption. Moreover, the driver sequentially supplies the drive current to the electrodes of the respective display devices until the end of the frame period or beyond this frame period to a subsequent frame period. This further lowers the signal frequency and improves screen flicker.

Further, at least one memory device may be provided in correspondence with each display device, or a single driver may be provided in correspondence with each display device. With this arrangement, the individual display devices are independently operable with a low signal frequency. Alternatively, a plurality of display devices may be allocated to one driver, in which case, cost reduction can be achieved while the image quality is preserved.

According to another form of the flat panel display apparatus of the present invention, the delay circuit provides timings in a chronological order to the memory cell unit, which then records image pixel signals in a time sequential order. Also, the memory cell unit reads the pixel signals by receiving timings in a time sequential order from the delay circuit. Thus, by only using this flat panel display apparatus, image recording and reproducing operations can be performed exhibiting good reproducibility and excellent random access characteristics without a loss in image quality.

According to the display apparatus of the present invention, a plurality of display devices each with a flat top surface provided in the proximity of the surface of a transparent or translucent display plate are independently moved by a moving mechanism until the device is brought into contact with the display plate. Each of the display devices is moved in accordance with the on/off state of an image signal. Thus, image display is performed. The top surface of each of the display devices may be colored, in which case, the level of contrast can be enhanced.

The moving mechanism may comprise a coil which can generate an induction magnetic field by an energized magnetization current, and a magnetization circuit which can supply magnetization currents in both forward and reverse directions to the coil. The display device may comprise a permanent magnet or a material exhibiting a magnetic effect and be disposed movably up and down within the coil. In this case, the moving mechanism may be constructed of a magnetic-field-driving-type micromachine. Thus, miniature-sized apparatuses can be efficiently produced.

Also, the display device is attracted to a magnetic strip embedded in the vicinity of the reverse surface of the display plate by the magnetization of the coil, thereby achieving stable pixel formation. The pixel formed on the top surface of the display device can be visually recognized from the obverse surface of the display plate through an opening at the center of the magnetic strip.

The attractive force between the display device and the magnetic strip is made larger than the gravitational force upon the display device. Accordingly, the attraction state can be maintained even though the magnetization current is interrupted. Thus, pixel display can be continued. During this attraction state, a magnetization current in the reverse direction is supplied to the coil. This releases the attractive force to separate the display device from the display plate because the force for attracting the display device due to an induction magnetic field generated by the coil is made larger than the attractive force between the display device and the magnetic strip. Thus, the displayed pixel is eliminated.

With this arrangement, the duration during which the magnetization current is activated is equal to at least a time width for releasing the attractive force between the display device and the magnetic strip. Consequently, pixel display in accordance with the on/off state of a pixel signal can be performed with minimum power supply.

Additionally, the top surface of each of the display devices may be colored, thereby easily recognizing the pixel and further enabling color image display.

According to the display method of the present invention, the on/off state of the pixel is expressed by the level of contrast by the following two states: the contact state in which the top surface of the display device contacts an irregular reflection surface formed on the reverse surface of a transparent or translucent display plate, and the non-contact state in which the top surface of the device separates from the display plate.

In the non-contact state, rays within the display plate are irregularly reflected on the irregular reflection surface formed on the reverse surface of the display plate, increasing the illuminance of the display plate and causing a disparity in the illuminance between the display device and the display plate positioned away from the device. Accordingly, the display device located away from the display plate cannot be visually recognized from the obverse surface of the plate.

On the other hand, in the contact state, since irregular-reflection state of rays within the display plate is changed, the display device can be visually recognized from the obverse surface of the display plate. As a consequence, the level of contrast between the contact state and the non-contact state can be enhanced to improve display characteristics.

DESCRIPTION OF THE PREFERRED EMBODIMENTS

Figure 1:
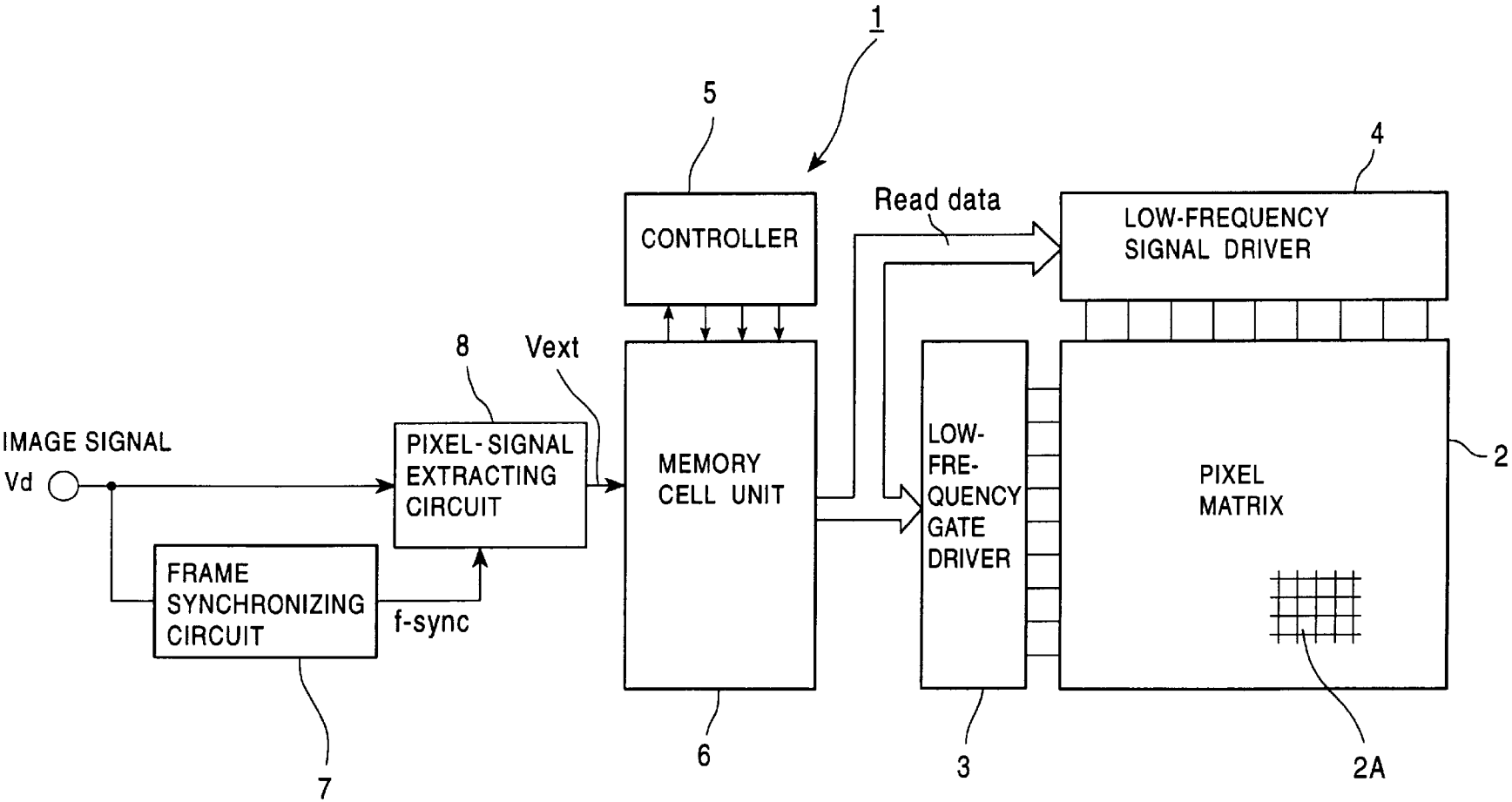
FIG. 1 is a block diagram of a flat panel display apparatus according to an embodiment of the present invention.

A description will now be given of embodiments of the present invention with reference to the accompanying drawings.

Referring to a block diagram illustrating an embodiment of the present invention shown in FIG. 1, a flat panel display apparatus generally indicated by 1 is constructed of the below-described elements. A pixel matrix 2 has a plurality of display devices 2A arranged in a matrix form. A frame synchronizing circuit 7 extracts a frame synchronizing signal f-sync from an input high-frequency image signal Vd and outputs f-sync to a pixel-signal extracting circuit 8. The pixel-signal extracting circuit 8 receives the image signal Vd to extract a given pixel signal Vext from the image signal Vd and outputs it to a memory cell unit 6. The memory cell 6 receives the pixel signal Vext and stores it therein. A low-frequency gate driver 3 and a low-frequency signal driver 4 sequentially supply, based on a pixel signal read from the memory cell 6, drive currents to the electrodes provided for the individual display devices 2A for a predetermined duration within a frame period. A controller 5 controls the reading and writing of data from and into the memory cell 6. Assuming that the gate driver 3 and the signal driver 4 are integrated into a pair, a pair of drivers may be allocated to one display device or to a plurality of devices.

Figure 2:
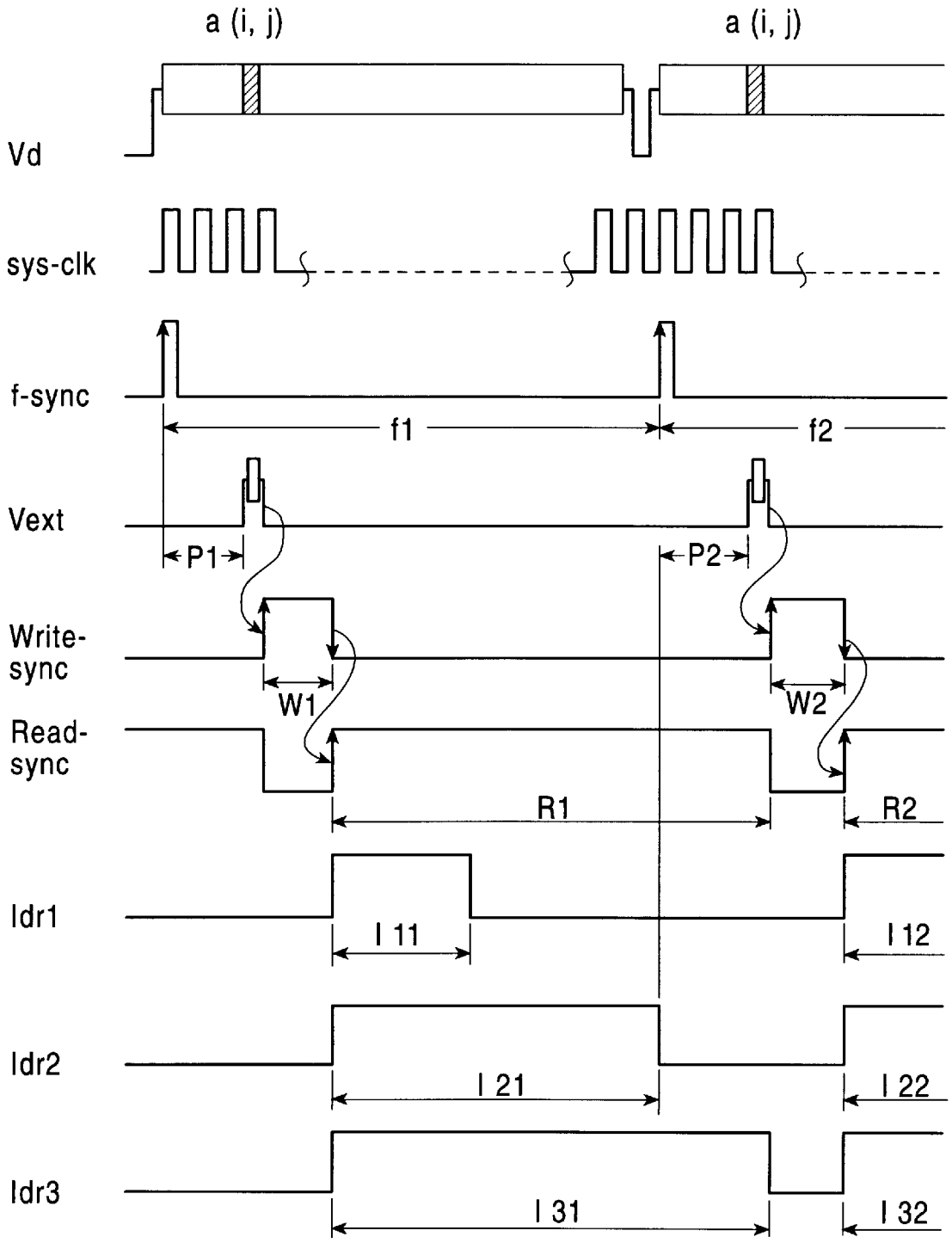
FIG. 2 is a timing chart of the flat panel display apparatus shown in FIG. 1.

The operation of the display apparatus 1 constructed as described above will now be explained while referring to FIG. 2. An image signal Vd is input into the frame synchronizing circuit 7, which then extracts a frame synchronizing signal f-sync from the image signal Vd and outputs it to the image-signal extracting circuit 8. The circuit 8 extracts a pixel signal Vext corresponding to a given pixel a(i, j) from the image signal Vd in synchronization with the duration of time P1 starting from the rise time of the frame synchronizing signal f-sync. The extracted pixel signal Vext is then output to the memory cell 6 and routed to the controller 5 through the memouy cell 6.

Upon receiving the pixel signal Vext through the memory cell 6, the controller 5 generates a write signal Write-sync at the timing of a rise or fall of the pixel signal Vext and outputs the write signal Write-sync to the memory cell 6. Subsequently, the memory cell 6 receives the pixel signal Vext through a delay circuit 5A (FIG. 6) and stores it in a memory. The duration of a writing operation is indicated by W1. A read signal Read-sync falls at the rise of the write signal Write-sync.

Upon completion of writing the pixel signal Vext into the memory cell 6, the controller 5 raises the read signal Read-sync, and simultaneously, the pixel signal Vext which has been just stored in the memory is read from the memory cell 6. Thus, the given pixel a(i, j) corresponding to the pixel signal Vext continues to be displayed based on the pixel signal Vext at least during the same frame period.

A period R1 for the read signal Read-sync extends to a subsequent second frame. A certain duration within this period R1 can be determined as an excitation period for a display device. For example, as supplied from drivers 3, 4, a drive current excitation signal Idr1 may be set is set to have a relatively short excitation period I11 during which excitation is completed half way through the first frame. On the other hand, an excitation signal Idr2 is determined to contain an excitation period I21 that continues until the end of the first frame. In other words, in the excitation period I21, excitation is completed at the end of the first frame. An excitation signal Idr3 is set to include an excitation period I31 that extends to the second frame. Namely, among the above the excitation periods, the period I31 is the longest excitation period.

Figure 3:
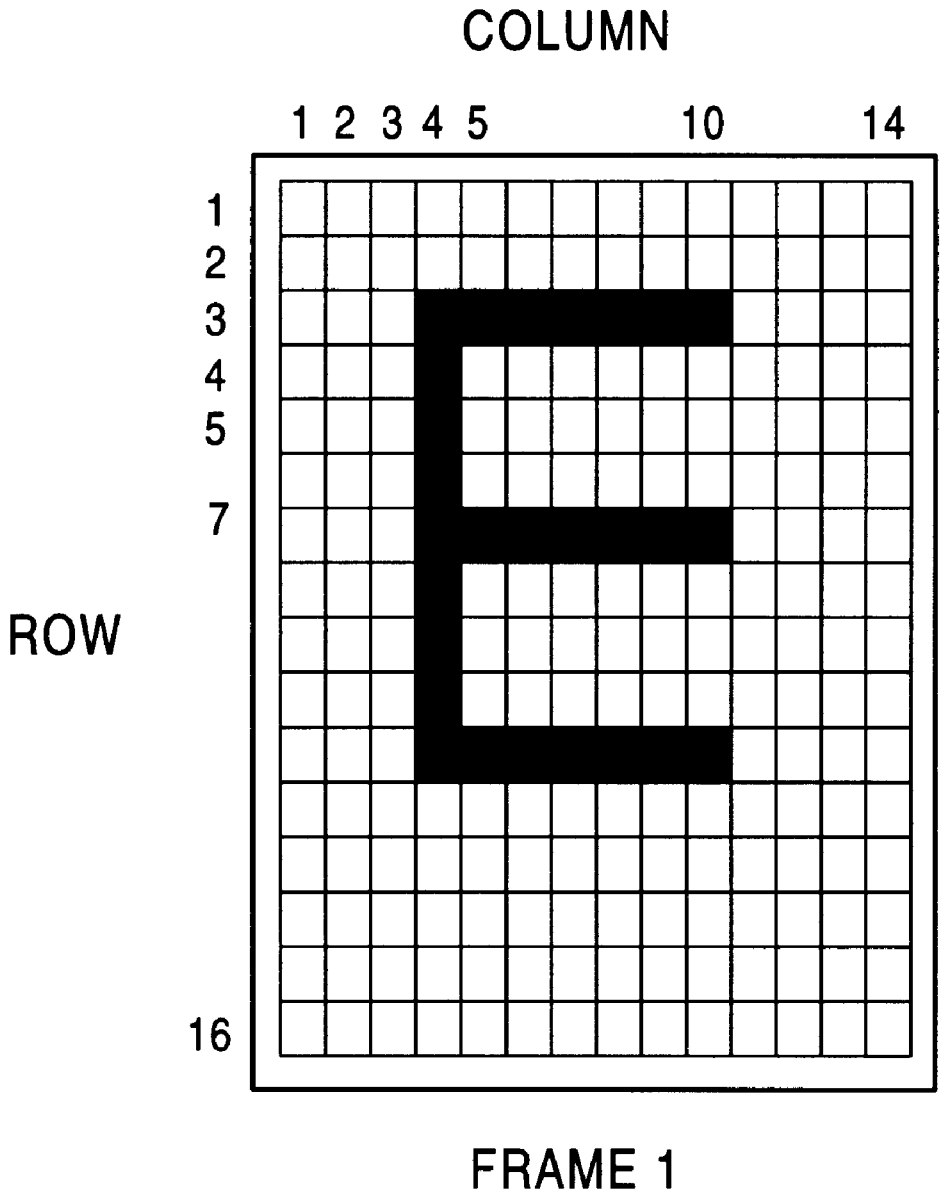
FIG. 3 schematically illustrates an example of a frame image.
Figure 5:
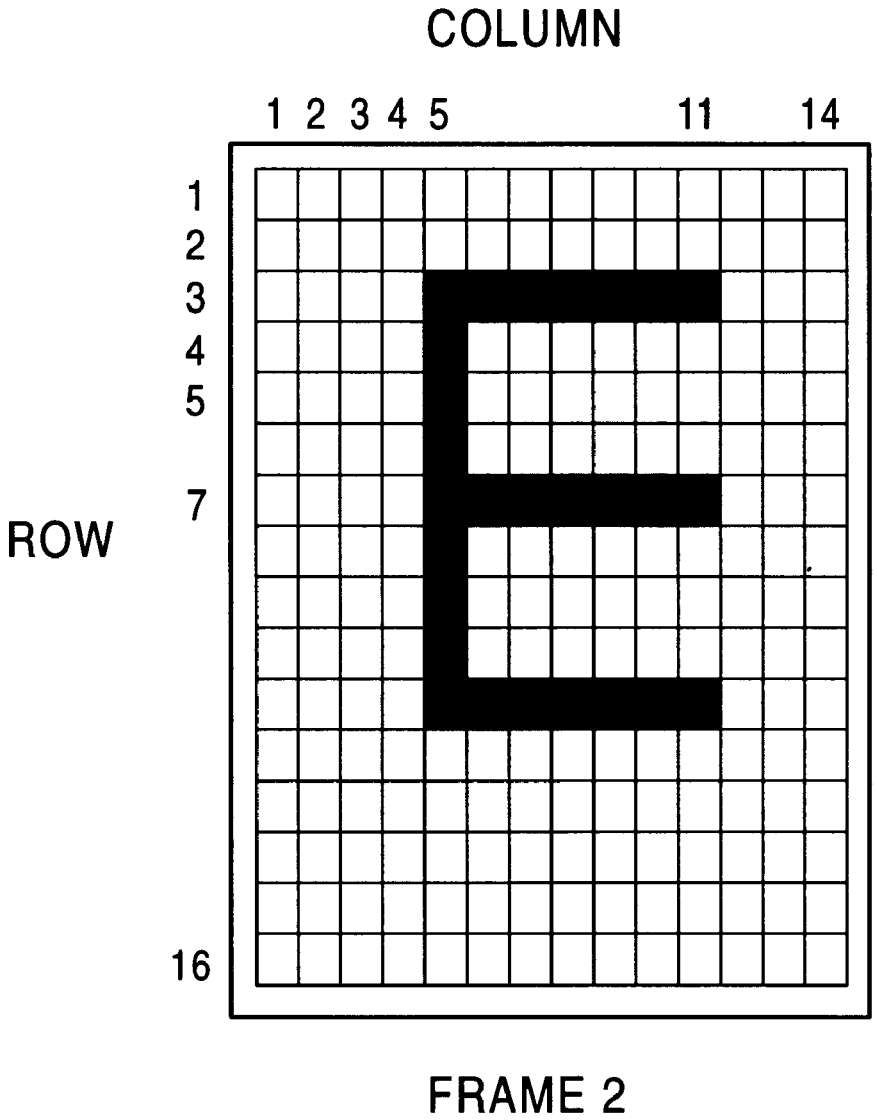
FIG. 5 schematically illustrates an example of a frame image.

FIG. 3 illustrates a first frame image (Frame 1 or f1) formed of 16 rows by 14 columns, i.e., a total of 244 pixels, expressing a character E. This first frame image (f1) is displayed for 1/24 seconds, followed by a second frame image (f2) shown in FIG. 5 to be displayed for subsequent 1/24 seconds. This give the appearance that the character E is moving to the right of a display apparatus.

Figure 4:
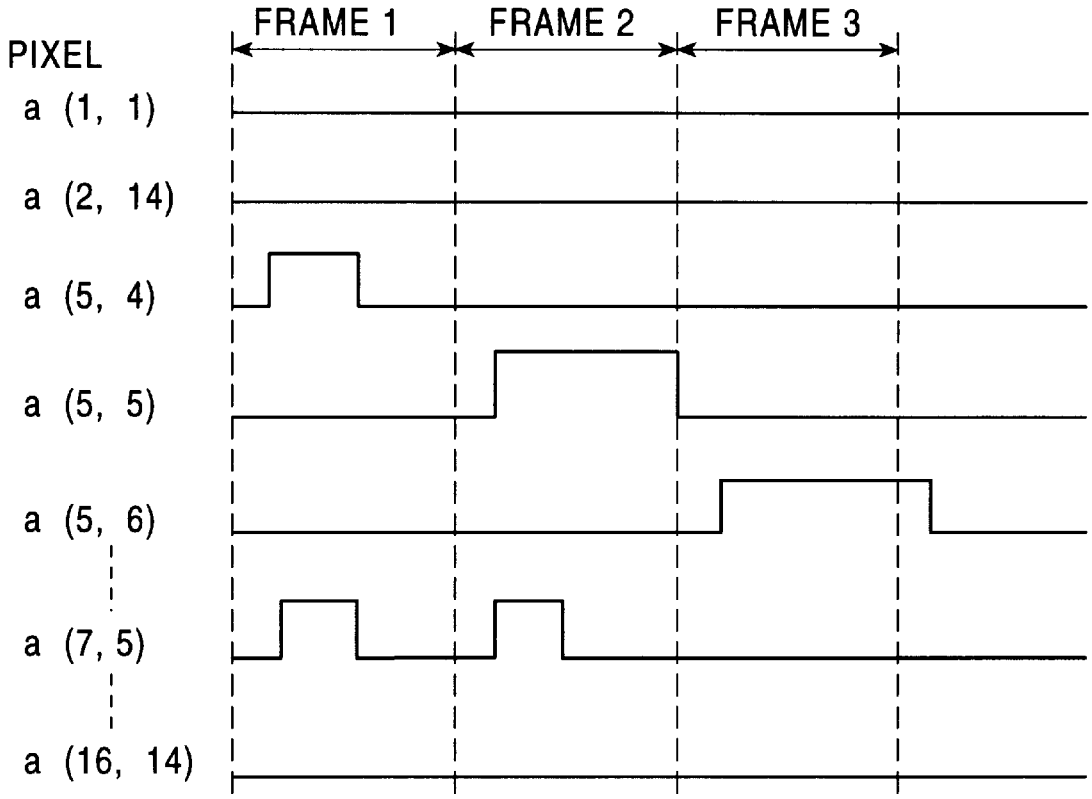
FIG. 4 is a timing chart of pixels in each frame.

FIG. 4 is a chart indicating an excitation period for each pixel in each frame when the first frame image (f1) shown in FIG. 3 is displayed by the flat panel display apparatus shown in FIG. 1. FIG. 4 reveals that the excitation period for the display device forming, for example, the pixel a(5, 4) of the first frame image (f1) makes up approximately two fifths of the first frame period. Considering that the excitation period for a known type of display apparatus is one 224th of the first frame period, the on/off signal frequency is significantly reduced in this apparatus. In other words, a known type of display apparatus would have to cycle about 98 times (=244×2/5) between on and off to obtain an excitation period equivalent to that obtained by one cycle of the invention.

The excitation period for the display device constituting the pixel a(5, 5) of the second frame image (f2), which may last until the end of the second frame period, occupies about four fifths of the second frame period. Accordingly, the on/off signal frequency is further lowered. Moreover, the excitation period for the display device forming the pixel a(5, 6) of the third frame image extends to a fourth frame period, thereby even further reducing the on/off signal frequency.

The on/off signal frequency can be reduced in the above-described fashion to drastically decrease electromagnetic noise and power consumption. Moreover, the longer excitation period for each pixel, i.e., the longer display time, can increase the luminance of the screen, thereby decreasing image flicker. Further, reduced power consumption enables application of this display apparatus in mobile equipment, and the use of a low-frequency driver can implement cost reduction. Additionally, display devices exhibiting only a relatively low response speed can be used in this apparatus.

The display devices forming the pixel a(7, 5) of the first and second frame images must use the same drivers in a time-division manner because the pixel a(7, 5) is excited during both the first and second frame periods. This entails that the excitation of the pixel a(7, 5) be suspended half way through each of the first and second frame periods. Yet, a considerable lowered frequency effect can still be expected, and thus, the number of drivers can be further decreased, resulting in reduced cost.

Figure 6:
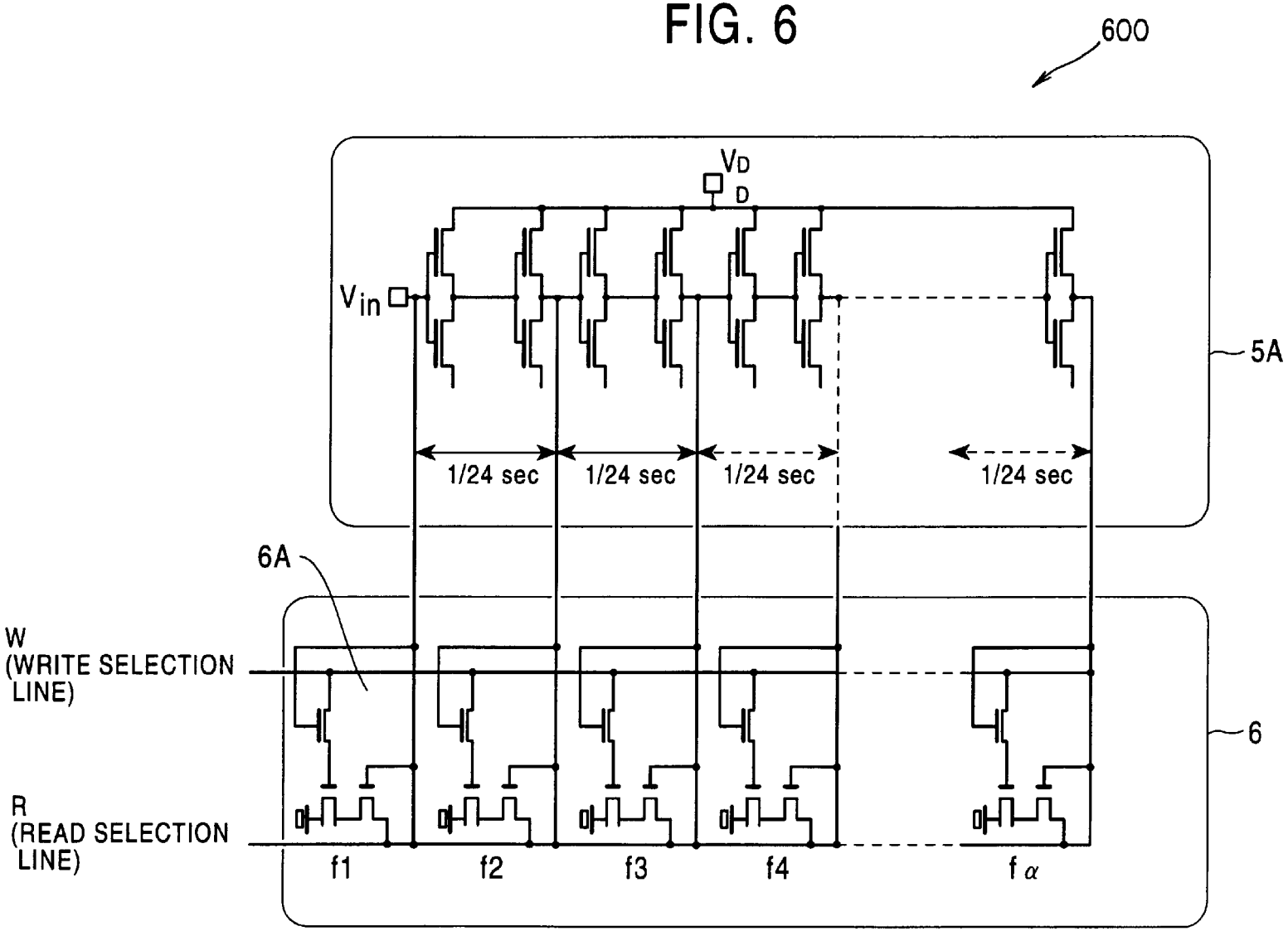
FIG. 6 is a block diagram of the essential portion of a flat panel display apparatus according to another embodiment of the present invention.

FIG. 6 is a block diagram illustrating the essential portion of a flat panel display apparatus according to another embodiment of the present invention. This display apparatus 600 is loaded with an image recording/reproducing function. Elements other than the essential elements shown in FIG. 6 are similar to those shown in FIG. 1, and thus, the flat panel display apparatus 600 will be explained while referring to FIGS. 1 and 6.

The flat panel display apparatus 600 is constructed of the following elements. Referring to FIG. 1, the apparatus 600 has a pixel matrix 2 provided with a plurality of display devices 2A. A pixel-signal extracting circuit 8 extracts a signal corresponding to a given pixel from a high-frequency image signal. A memory cell 6 formed of a plurality of memory cells 6A records in a chronological order a plurality of time-sequential pixel excitation signals associated with a given pixel respectively extracted from a plurality of time-sequential frame images. A delay circuit 5A sequentially sends read signals to the plurality of memory cells 6A while providing a predetermined time lag. Drivers 3 and 4 sequentially feed drive currents to the respective electrodes provided for the display device 2A based on a pixel excitation signal Read data read from the memory cell unit 6.

According to the display apparatus constructed as illustrated in FIG. 6, the memory cell unit 6 has $\alpha$ number of memory cells 6A, and pixel excitation signals of a given pixel arranged on $\alpha$ a number of frame images are sequentially recorded in the a number of memory cells 6A in a time sequential order. Accordingly, the number of memory cell units 6 is equal to the number of pixels in pixel matrix 2A.

The $\alpha$ number of memory cells 6A are sequentially triggered at a time lag of 1/24 seconds. The $\alpha$ number of trigger signals with a time lag of 1/24 seconds are sequentially input into the memory cells 6A from the delay circuit 5A. The delay circuit 5A is formed of multi-staged ring oscillators. The individual memory cells 6A are operable in two modes, such as write and read modes. The write or read mode is selected by inputting a signal from the controller 5 (FIG. 1) through a write selection line W or a read selection line R.

Although the ring oscillators are used for the delay circuit 5A of the apparatus shown in FIG. 6, they are not exclusive. Any circuit can be employed as long as it can access the memory cells 6A with a predetermined delay time in accordance with a change in the image frame.

The operation of this display apparatus 600 will now be explained. If a write mode is input through the write selection line W, a signal corresponding to a given pixel, for example, a pixel excitation signal associated with pixel a(i, j) (FIG. 2), is extracted from each of image signals Vd of the α number of frames fl, f2, . . . , fα arranged in a time sequential order, based on the α number of trigger signals having a time lag of 1/24 seconds that are sequentially input into the respective memory cells 6A from the delay circuit 5A. Then, the extracted α number of pixel excitation signals are written into the corresponding α number of memory cells 6A. One memory cell unit 6 is allocated to each pixel, and pixel excitation signals are time-sequentially recorded with respect to all the pixels in a manner similar to the above recording operation.

In contrast, if the read mode is input through the read selection line R, the pixel signals associated with a given pixel recorded on the α number of memory cells 6A are read in a time sequential order based on α number of trigger signals with a time difference of 1/24 seconds that are sequentially input into the respective memory cells 6A from the delay circuit 5A. During this reading operation, image disturbance can be prevented by synchronizing the input/output of the leading memory cell 6A to an input signal Vin of the ring oscillator and also by synchronizing the input/output of the signals corresponding to the other memory cells 6A to the input signal Vin.

Based on the read pixel signals, the corresponding display device 2A (see FIG. 1) is excited or lit. Time-sequential reproduction of pixel signals is performed in the afore-described manner with respect to all the pixels, thereby sequentially displaying the α number of frame images.

Figure 7:
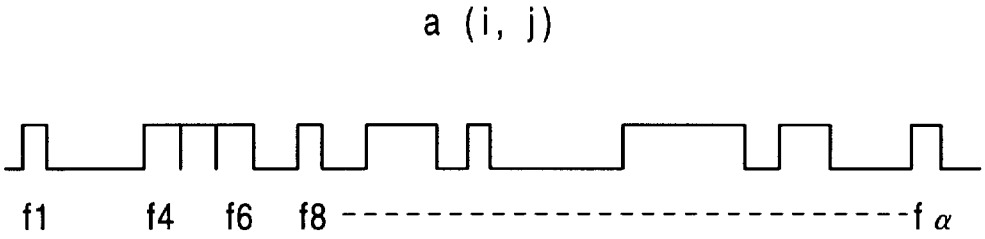
FIG. 7 illustrates the pixel display in a time sequential order.

For example, if an image for one second consists of 24 frames, and recording is performed for one hour (3600 seconds), the total number of frames results in 86400. The pixel signals to be applied to the pixel a(i, j) change with respect to each frame image, as indicated in FIG. 7. The symbol fα indicates a signal to be applied to the pixel a(i, j) in the final frame image (86400th frame image). As a consequence, video recording for several minutes to several dozens of minutes, for example, is made possible only by use of this flat panel display apparatus without requiring a specific external storage device (for example, a hard disk).

Although a DRAM cell is used as a memory cell in this apparatus shown in FIG. 6, the other types of memory cells, such as a flash memory and SRAM, may be employed. Further, as the display devices 2A, various types of light emitting devices, such as a liquid crystal display (LCD) and a field emission display (FED), and various types of non-luminous devices, such as micromachines, may be used.

Figure 8:
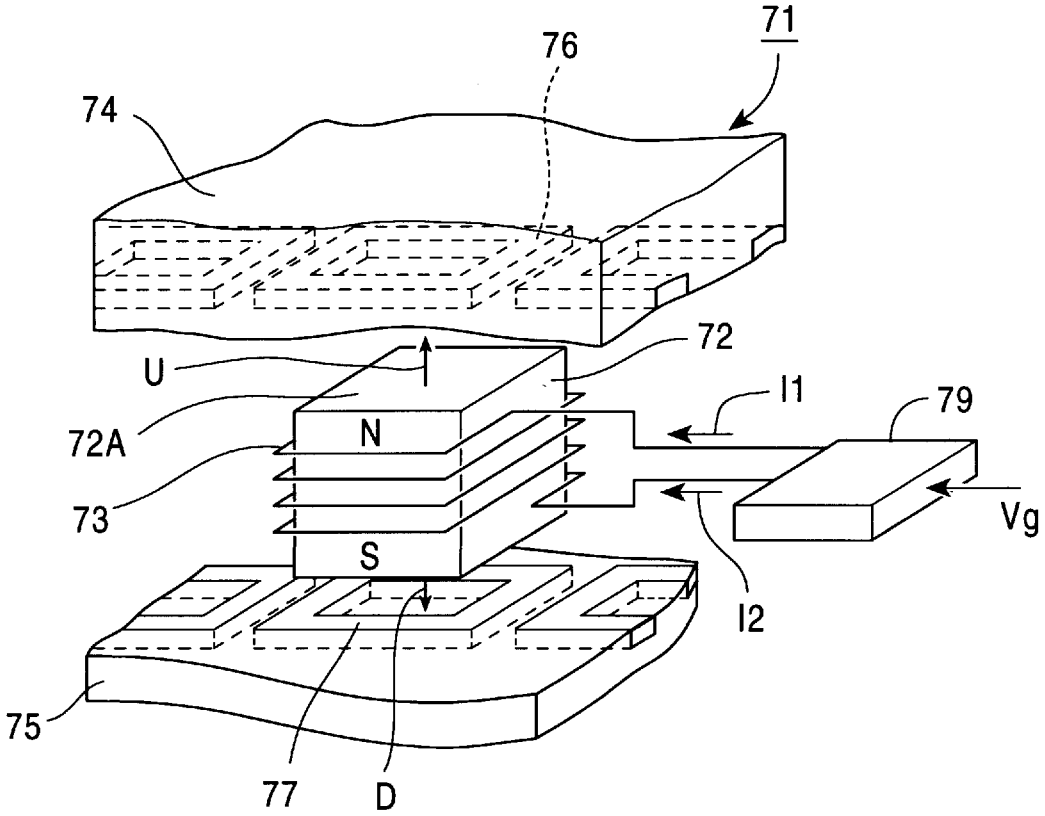
FIG. 8 is a perspective view of the essential portion of a display apparatus according to an embodiment of the present invention.
Figure 9:
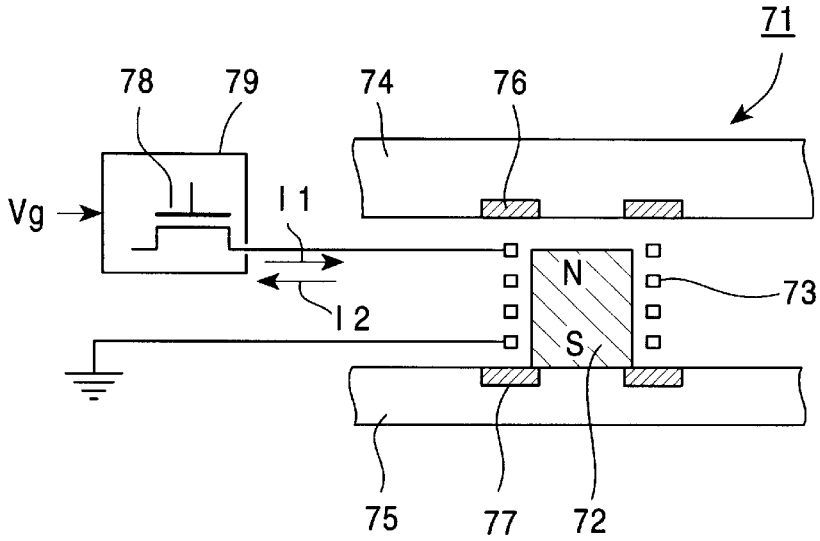
FIG. 9 is a front sectional view of the display apparatus shown in FIG. 8.

FIG. 8 is a perspective view of the essential portion of a display apparatus according to an embodiment of the present invention. FIG. 9 is a front sectional view of the display apparatus shown in FIG. 8, and FIG. 10 is a plan view of the apparatus shown in FIG. 8.

Figure 10:
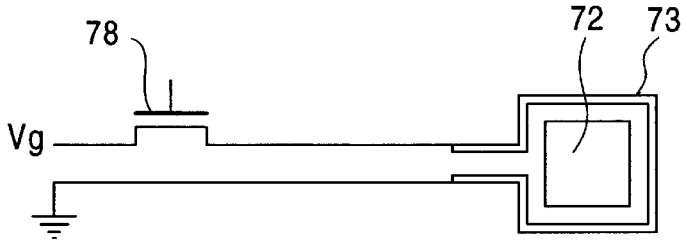
FIG. 10 is a plan view of the display apparatus shown n FIG. 8.

A display apparatus generally designated by 71 has, as illustrated in FIGS. 8 through 10, a transparent or translucent display plate 74(such as ulexite), a base member 75 disposed away from the unexposed or reverse surface of the display plate 74 at a predetermined distance, a plurality of coils 73 from which induction magnetic fields are generated in the directions indicated by the arrows U and D by energized magnetization currents I1 and I2, respectively, a magnetization circuit 79 for supplying the magnetization currents I1 and I2 to the coils 73, and a display device 72 disposed within each coil 73. The coil 73 and the magnetization circuit 79 constitute a moving mechanism.

A square-like magnetic strip 76 with an open center portion is embedded in the vicinity of the reverse surface of the display plate 74 in correspondence with one display device 72. A square-like magnetic strip 77 is also embedded in the base member 75 in correspondence with one display device 72. The magnetic strip 77 may be formed in a circular or a square-like shape with or without an open center portion.

Thus, a plurality of sets, each set consisting of the display plate 74, the base member 75, the coil 73, the display device 72, and the upper and lower magnetic strips 76 and 77 arranged between the display plate 74 and the base member 75, are arranged in a two-dimensional matrix form, each set corresponding to one pixel. Assuming that this set is referred to as a pixel unit, a frame consisting of, for example, 16 rows and 14 columns is constituted of a total of 224 pixel units.

Upon receiving the magnetization current I1 flowing in the forward direction indicated by the arrow in FIG. 8 from the magnetization circuit 79, the coil 73, formed in a square-like spiral shape, generates a magnetic field in the U direction (upward direction in FIG. 8). In contrast, when the magnetization current I2 flowing in the reverse direction is fed from the magnetization circuit 79, the coil 73 produces a magnetic field in the D direction (downward direction in FIG. 8). The magnetic fields generated as noted above induce the display device 72 formed of a permanent magnet to move up and down within the coil 73.

The magnetization circuit 79 may be allocated to each coil 73. Alternatively, the single magnetization circuit 79 may be allotted to a plurality of coils 73, in which case, the coils 73 may be sequentially magnetized by the circuit 79 in a time-division manner.

The magnetization circuit 79 determines the direction of a magnetization current (for example, the forward current I1) at a timing when an image signal Vg is turned on, thereby actuating a built-in magnetization switch 78 for a predetermined duration. The time period during which the switch 78 (FIGS. 9, 10) is in the on state is equivalent to a magnetization time period used for generating a magnetic field in the U direction by the coil 73. Also, the magnetization circuit 79 determines the direction of a magnetization current (for example, the reverse current I2) at a timing when the image signal Vg is turned off, thereby actuating the built-in magnetization switch 78 for a predetermined duration. The time period during which the switch 78 is in the on state is equivalent to a magnetization time period for generating a magnetic field in the D direction by the coil 73.

Figure 11:
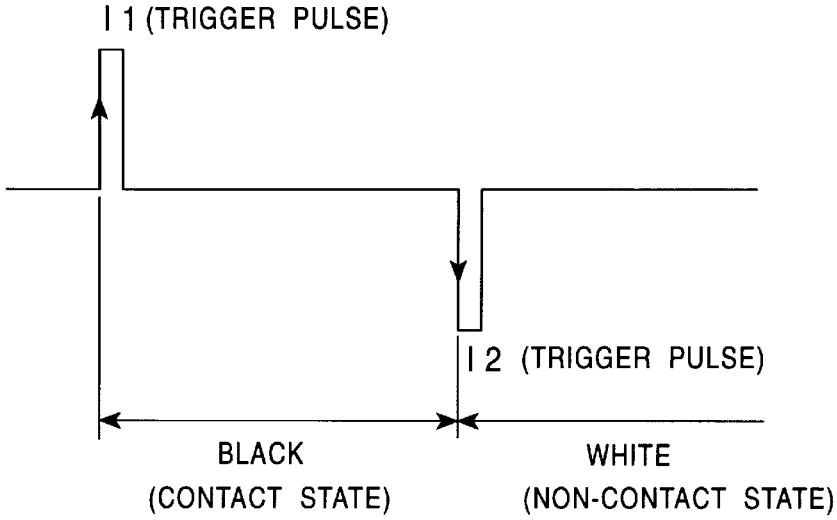
FIG. 11 illustrates a magnetization current.

The operation of the display apparatus shown in FIG. 8 will now be explained while referring to FIG. 11 illustrating the configuration of a magnetization current. At a timing when the image signal Vg input into the magnetization circuit 79 is turned on, the circuit 79 generates a forward current to actuate the magnetization switch 78 for a predetermined duration, thereby producing a trigger pulse I1 with a positive potential. This trigger pulse I1 magnetizes the coil 73 to generate a magnetic field in the U direction. The time period during which the magnetization switch 78 is in the on state is equal to a width of the trigger pulse I1.

The peak and width of the trigger pulse I1 are determined so that the force to attract the display device 72 in the U direction caused by the induction magnetic field formed by the coil 73 is larger than the attractive force between the display device 72 and the lower magnetic strip 77. This separates the display device 72 from the lower magnetic strip 77 to shift the device 72 in the U direction, and the display device 72 is finally attracted to the upper magnetic strip 76 when the upper surface 72A of the device 72 contacts the reverse surface of the display plate 74. In this manner, the display device 72 is attracted to the magnetic strip 76 to maintain the state in which the upper surface 72A of the display device 72 keeps in contact with the reverse surface of the display plate 74, thereby achieving stable black-color (or other color) pixel formation. The pixel formed on the upper surface 72A of the display device 72 can be visually recognized from the exposed or obverse surface of the display plate 74 through an opening at the center of the magnetic strip 76.

The trigger pulse I1 disappears after a lapse of a predetermined time subsequent to the attraction of the display device 72 to the magnetic strip 76. However, the attractive force between the display device 72 and the magnetic strip 76 is larger than the gravitational force upon the device 72, thereby maintaining the state in which the display device 72 is attracted to the magnetic strip 76. Accordingly, the display device 72 keeps in contact with the display plate 74, so that pixel display can be continued without supplying energy, thereby enabling a significant reduction in power consumption.

When the image signal Vg is turned off while the pixel is displayed, the magnetization circuit 79 generates a reverse current and then actuates the magnetization switch 78 for a predetermined duration, thereby producing a trigger pulse I2 with a negative potential. This trigger pulse I2 magnetizes the coil 73 in the reverse direction to produce a magnetic field in the D direction. As described above, the time period during which the magnetization switch 78 is actuated is equivalent to a pulse width of the trigger pulse I2.

The peak and width of the trigger pulse I2 are determined so that the force for attracting the display device 72 in the D direction caused by an induction magnetic field formed by the coil 73 is larger than the attractive force between the display device 72 and the upper magnetic strip 76. This separates the display device 72 from the upper magnetic strip 76 to shift it in the D direction, and the display device 72 is finally attracted to the lower magnetic strip 77 when the lower surface of the device 72 contacts the obverse surface of the base member 75. In this fashion, the display device 72 is attracted to the magnetic strip 77 as seen in FIG. 10 to maintain the non-contact state in which the upper surface 72A of the display device 72 keeps away from the reverse surface of the display plate 74, thereby achieving stable white-color pixel formation. As a result, the upper surface 72A of the display device 72 cannot be visually recognized from the obverse surface of the display plate 74.

The trigger pulse I2 disappears after a lapse of a predetermined time subsequent to the attraction of the display device 72 to the magnetic strip 77. However, the attractive force between the display device 72 and the magnetic strip 77 is larger than the gravitational force upon the device 72, thereby maintaining the state in which the display device 72 is attracted to the magnetic strip 77. This attraction state can be stably maintained even when the apparatus is inclined or falls in the direction of the gravitational force. Accordingly, white pixel display can be continued without supplying energy, thereby enabling a vast reduction in power consumption.

According to the above description, a period during which a magnetization current is effective can be reduced to a minimal level which is at least required for releasing the attractive force between the display device and a magnetic strip. Hence, the pixel display operation representing the on or off state of a pixel signal can be implemented with minimum power.

Figure 12:
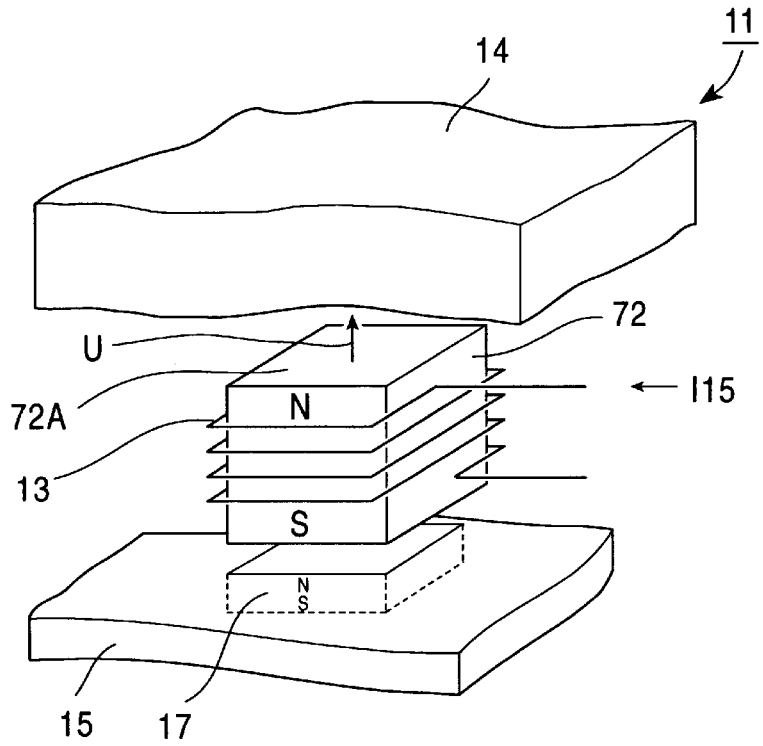
FIG. 12 is a perspective view of the essential portion of a display apparatus according to another embodiment of the present invention.
Figure 13:
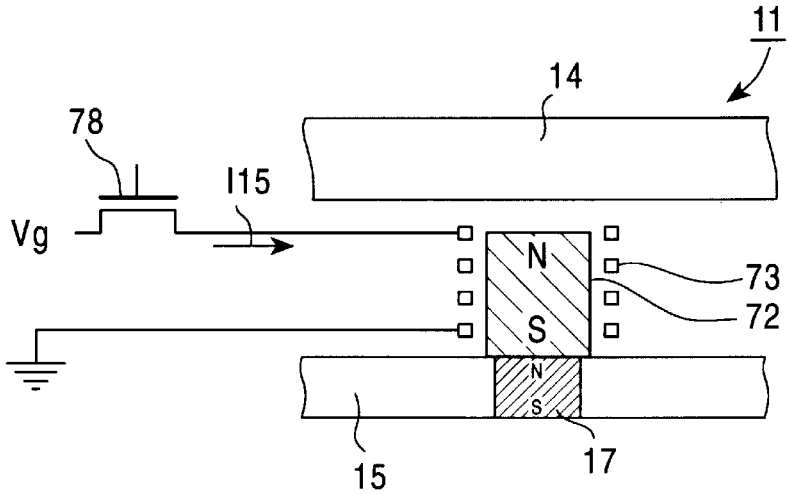
FIG. 13 is a front sectional view of the display apparatus shown in FIG. 12.

FIG. 12 is a perspective view of the essential portion of a display apparatus 11 according to an alternative embodiment of the present invention. FIG. 13 is a front sectional view of the display apparatus 11 shown in FIG. 12.

A display apparatus generally represented by 11 has, as illustrated in FIGS. 12 and 13, a transparent or translucent display plate 14, a base member 15 disposed away from the reverse surface of the display plate 14 at a predetermined distance, a plurality of coils 13 disposed between the display plate 14 and the base member 15 to generate an induction magnetic field by an energized drive current I15 in the direction indicated by the arrow U in FIG. 12, and a display device 72 with a flat upper surface 72A located within each coil 13.

Provided for the base member 15 by means such as embedding is a square-like permanent magnet 17 in correspondence with each display device 72. This permanent magnet 17 may be formed in other shapes, such as a circle.

Thus, a plurality of sets, each set consisting of the coil 13, the display device 72 and the permanent magnet 17, are arranged in a two-dimensional matrix form between the display plate 14 and the base material 15. Each set is associated with one pixel. Assuming that this set is referred to as a pixel unit, a frame consisting of, for example, 16 rows and 14 columns, is constituted of a total of 224 pixel units.

A magnetization current I15 indicated by the arrow in FIG. 12 flows in the square-like spiral coil 13 to generate a magnetic field in the U direction (upward direction in FIG. 12). Due to this magnetic field, the display device 72 formed of a permanent magnet is shifted upward within the coil 13.

Figure 14:
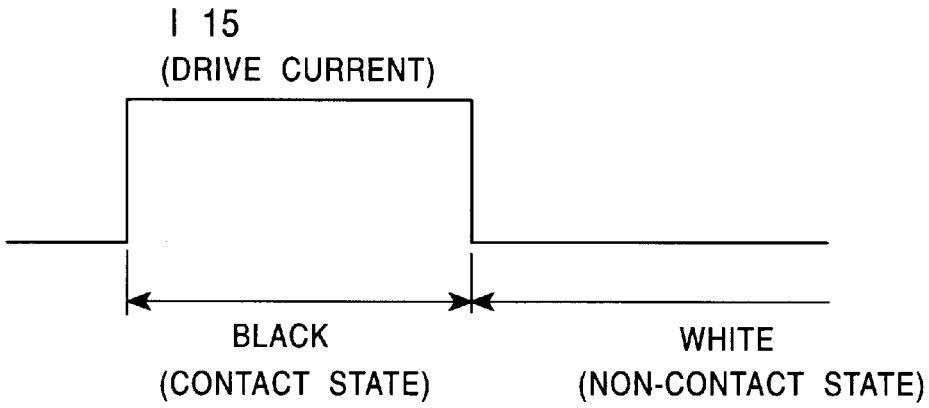
FIG. 14 illustrates a drive current.

A description will now be given of the operation of the display apparatus 11 while referring to FIG. 14 illustrating the configuration of a drive current.

At a timing of activating the image signal Vg, the magnetization switch 78 is turned on to cause a drive current I15 with a positive potential to flow in the coil 13. The coil 13 is thus magnetized to generate a magnetic field in the U direction. Due to this magnetic field, the display device 72 is separated from the permanent magnet 17 and shifted in the U direction to bring the upper surface 72A of the display device 72 into contact with the reverse surface of the display plate 14. Thus, a pixel is formed in a color (black or other color) of the upper surface 72A. This pixel can be visually recognized from the obverse surface of the display plate 14.

Then, when the image signal Vg is inactivated, the magnetization switch 78 is turned off, interrupting the drive current I15 to eliminate the magnetic field. Accordingly, the display device 72 drops by gravitation to contact at its lower surface the upper surface of the base member 15, and at this time, the device 72 is attracted to the permanent magnet 17. Consequently, the upper surface 72A of the display device 72 keeps away from the reverse surface of the display plate 14, thereby stably performing white-pixel formation. Thus, pixel display can be implemented with a simple construction of the display apparatus.

Figure 15:
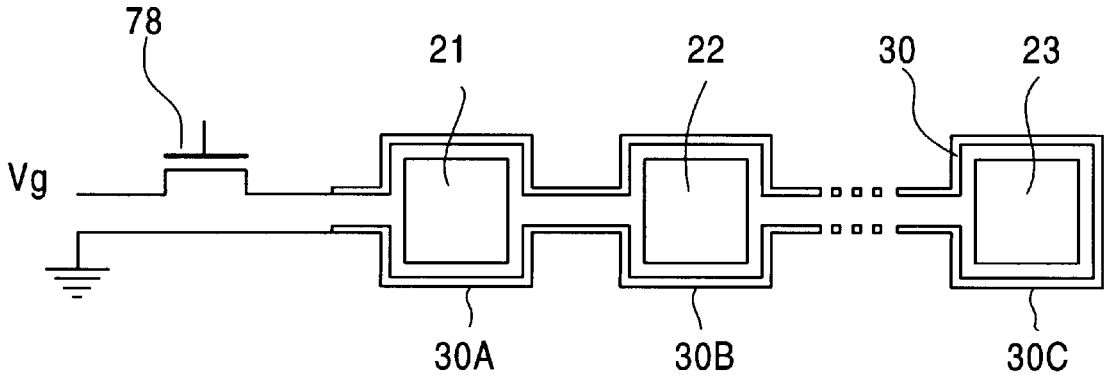
FIG. 15 is a plan view of an example of modifications to the coil used in the display apparatus of the present invention.

FIG. 15 is a plan view of an example of modifications to the coil used in the display apparatus of the present invention. A coil 30 is formed of a plurality of open rings 30A, 30B and 30C connected in series to each other, which surround display devices 21, 22 and 23, respectively. With this construction, the same magnetization current can magnetize the plurality of open rings 30A, 30B and 30C at one time, thereby simultaneously moving the display devices 21, 22 and 23. Since each ring can be connected to either polarity, the individual display devices 21, 22 and 23 can be shifted at one time in desired directions (up and down directions). Accordingly, a predetermined pattern can be displayed in an instant.

Figure 16:
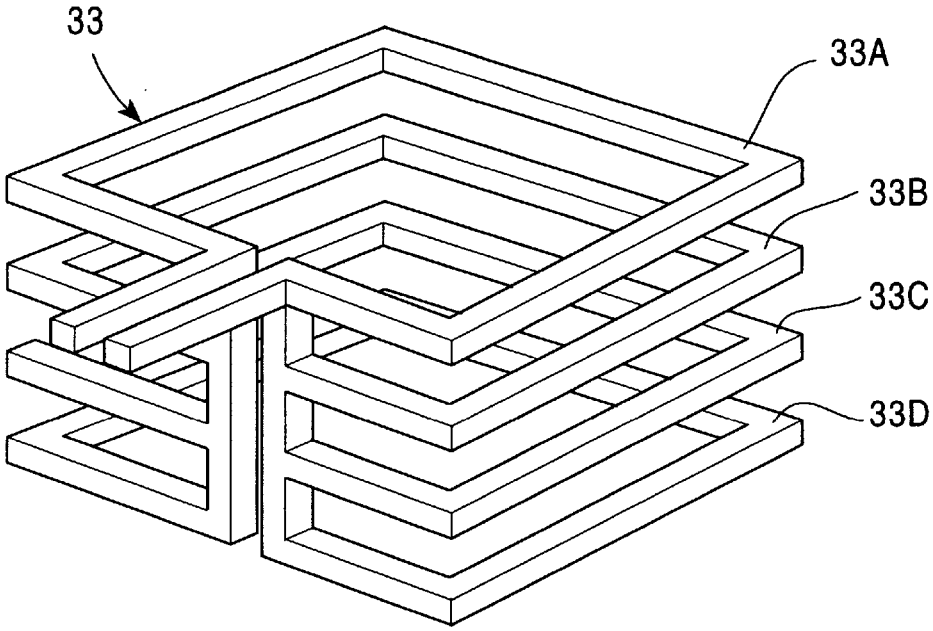
FIG. 16 is a perspective view of another example of modifications to the coil used in the display apparatus of the present invention.

FIG. 16 is a perspective view of another example of modifications to the coil used in the display apparatus of the present invention. A coil 33 is formed of a plurality of open rings 33A, 33B, 33C and 33D connected in parallel to each other arranged in the axial direction (vertical direction) with a gap.

Figure 20:
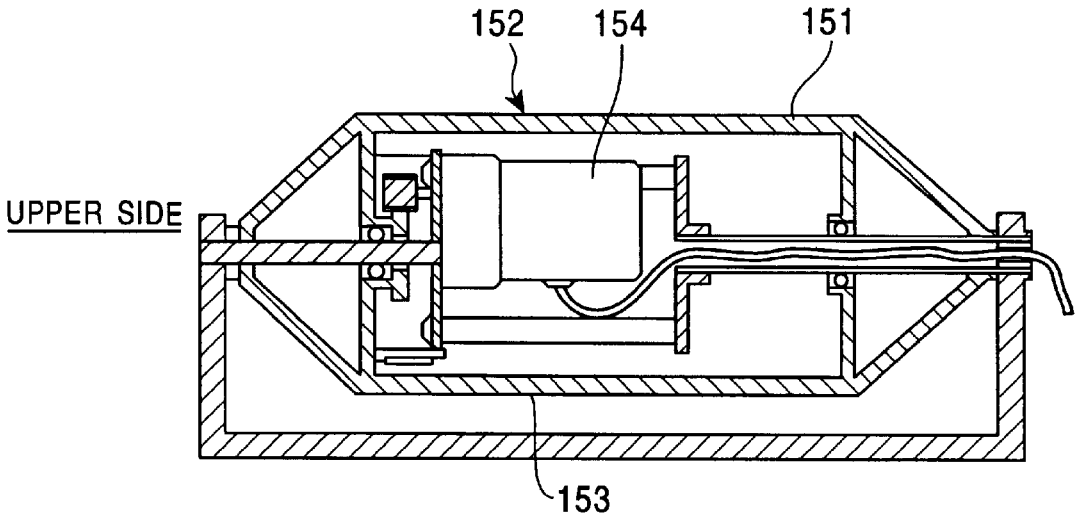
FIG. 20 PRIOR ART
FIG. 20 is a schematic view of a conventional electro-mechanical-type display apparatus.
Figure 21:
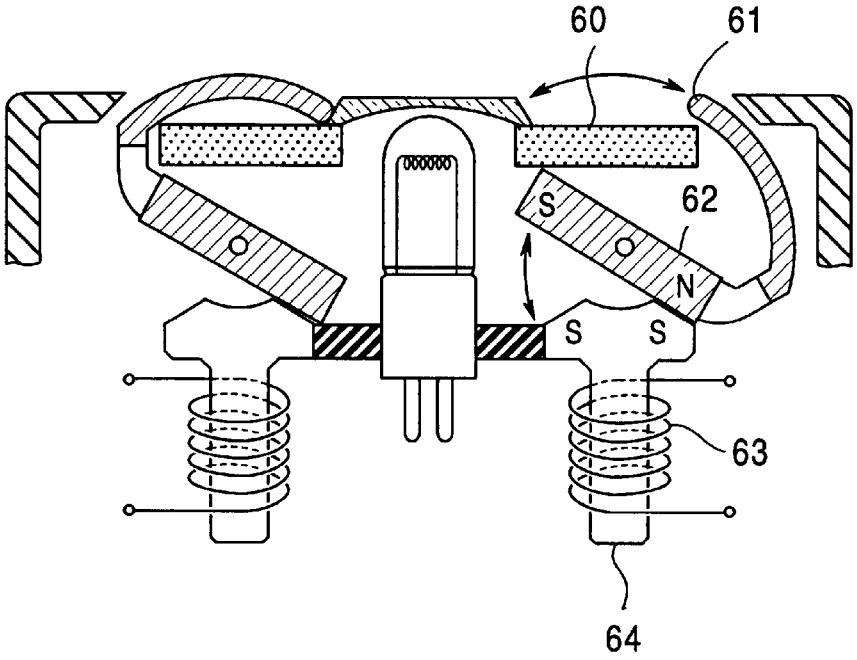
FIG. 21 PRIOR ART
FIG. 21 is a schematic view of another known electro-mechanical-type display apparatus.

Since a rotator or a rotator drive source (such as motor 154 of FIG. 20 ) is unnecessary to construct the display apparatus of the present invention, it is relatively easy to construct the display apparatus by arranging a plurality of reciprocating-drive type micromachines driven by a magnetic field. This makes it possible to mass-produce miniature high-definition display apparatuses.

Figure 17:
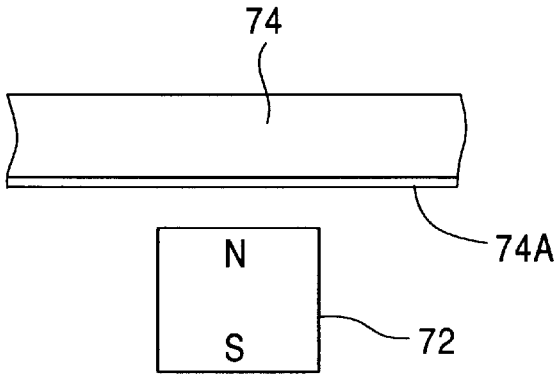
FIG. 17 is a front view illustrating the principle of a display method according to the present invention.
Figure 18:
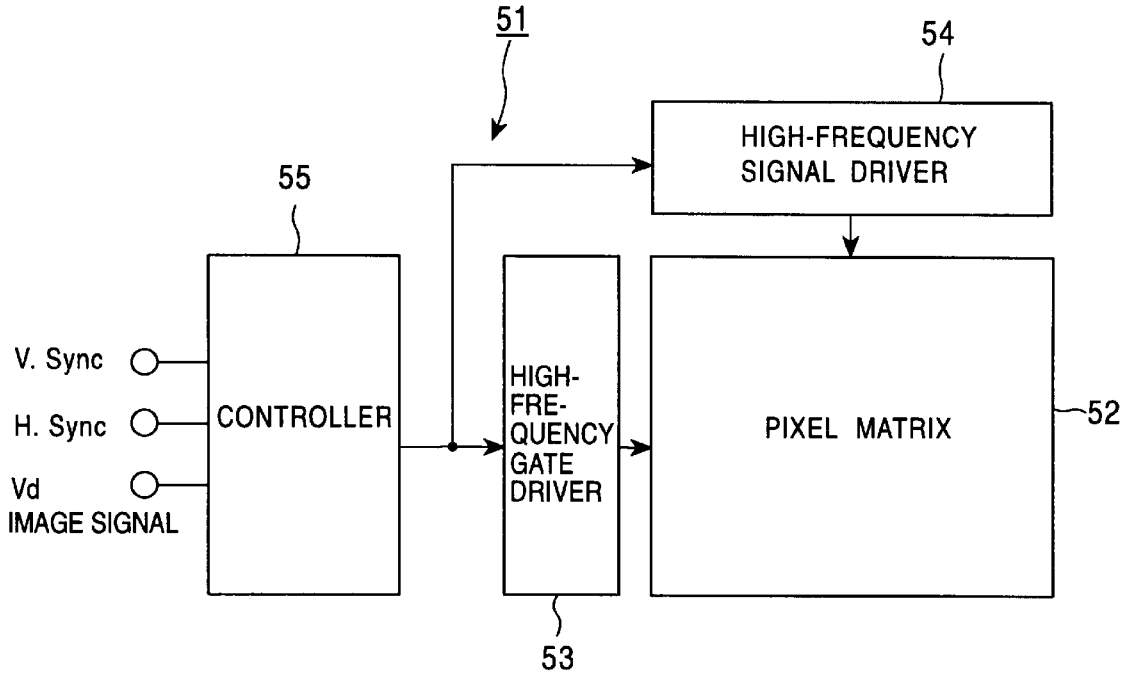
FIG.18 PRIOR ART
FIG. 18 is a block diagram of a known flat panel display apparatus.
Figure 19:
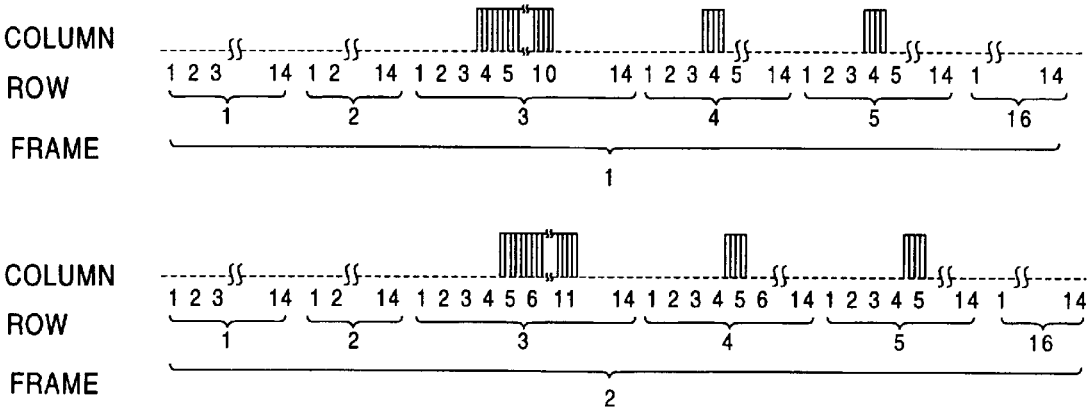
FIG. 19 PRIOR ART
FIG. 19 is a chart of an image signal input into the flat panel display apparatus shown in FIG. 18.

FIG. 17 illustrates the principle of a display method of the present invention. In this method, pixels are switched on or off according to a level of contrast between the following two states: the contact state in which the colored upper surface of the display device 72 is in contact with an irregular reflection surface 74A formed on the reverse surface of the display plate 74 and the non-contact state in which the upper surface of the display device 72 separates from the irregular reflection surface 74A of the display plate 74.

In the non-contact state, rays within the display plate 74 are irregularly reflected on the irregular reflection surface 74A, increasing the illuminance of the display plate 74 and causing a disparity in the illuminance between the display device 72 and the display plate 74 positioned away from the device 72. Accordingly, the display device 72 located away from the display plate 74 cannot be visually recognized from the obverse surface of the plate 74.

On the other hand, in the contact state, since irregular-reflection state of rays within the display plate 74 is changed, the display device 72 can be visually recognized from the obverse surface of the display plate 74. As a consequence, the level of contrast between the contact state and the non-contact state can be increased to improve display characteristics. If the display plate 74 is formed of, for example, glass, the irregular reflection surface 74A can be formed by sandblasting the reverse surface of the display plate 74.

As is seen from the foregoing description, the present invention offers the following advantages.

According to one form of the present invention, a flat panel display apparatus is provided with a memory cell corresponding to each pixel signal so as to significantly reduce the signal frequency. This can eliminate the need for the provision of a high-frequency wide-band amplifying circuit with large output, thereby drastically decreasing electromagnetic noise.

The use of a low-frequency narrow-band amplifying circuit with small output not only achieves cost reduction, but also enhances power saving because the apparatus is operable in response to a low-frequency signal. Due to the same reason, pixel display devices which are operable only at low frequencies, for example, non-luminous devices, such as micromachines, can be used. Accordingly, inconveniences, such as screen flicker and jitter, can be eliminated to obtain stable images and also to achieve low-power consumption.

According to another form of the present invention, a flat panel display apparatus has a memory cell unit for recording individual image-pixel signals in a time sequential order and a delay circuit for providing timings in a chronological order. Consequently, by only using this flat panel display apparatus, image recording and reproducing operations can be performed, resulting in exhibiting good reproducibility and excellent random access characteristics without a loss in image quality. Hence, this display apparatus finds extensive applications in households as well as in industrial fields, presenting remarkable effects in those fields.

Moreover, the display apparatus of the present invention is constructed of non-luminous display devices without using light emitting devices or backlight, thereby enabling low-power consumption for image display. Further, the activation period of a magnetization current can be reduced to a time width required for at least releasing the attractive force between a display device and a magnetic strip. Thus, image display can be continued even though the magnetization current is interrupted, thereby achieving a significant power reduction.

Additionally, pixel display is switched on or off by vertically shifting different-colored display devices, and the shape, color and illuminance of an overall image are expressed using non-luminous devices by reflecting external light. Accordingly, the display apparatus is suitable for outdoor use, and as it is simple in construction, it has fewer parts and reduces equipment and operating cost. Further, non-luminous devices reduce eyes fatigue and are thus easy on eyes. The display apparatus is thus suitable for machines used in offices.

According to the display method of the present invention, the on/off state of a display device is expressed by the level of contrast between the following two states: the contact state in which the obverse surface of the display device is in contact with the irregular reflection surface formed on the reverse surface of a transparent or translucent display plate, and the non-contact state in which the surface of the display device separates from the irregular reflection surface. Contrast enhancement is thus achieved, thereby improving display characteristics.

What is claimed is:

1. A flat panel display method in which a picture is formed by sequentially and continuously displaying a plurality of frame images during respective frame periods in a time sequential order, each of said frame images being formed by sequentially displaying a plurality of pixels arranged in a matrix form in a time-division manner during a frame period, said method comprising:

extracting a frame synchronizing signal from an image signal forming said frame image during the frame period;

receiving the frame synchronizing signal in an image-signal extracting circuit;

in the image-signal extracting circuit, extracting a pixel signal corresponding to a given pixel from the image signal in synchronization with the frame synchronizing signal;

receiving the pixel signal in a controller through a memory device;

generating a read signal in the controller at the timing of a change of the pixel signal;

storing the read signal in a memory device;

storing the extracted pixel signal in said memory device during said frame period;

reading the pixel signal stored in said memory device during said frame period by simultaneously raising the read signal; and exciting the pixel corresponding to the read pixel signal for a predetermined duration of said frame period.

2. A flat panel display method according to claim 1, wherein the pixel corresponding to the read pixel signal continues to be excited until the end of said frame period.

3. A flat panel display method according to claim 1, wherein the pixel corresponding to the read pixel signal continues to be excited beyond said frame period to a subsequent frame period.

4. A flat panel display apparatus comprising:

a plurality of display devices forming pixels arranged in a matrix;

a pixel-signal extracting circuit to extract a signal corresponding to a given pixel from a high-frequency image signal;

a memory device to store the extracted pixel signal;

a controller adapted to receive the extracted pixel signal through the memory device and to generate a read signal at the timing of a change of the pixel signal; and a driver to sequentially supply a drive current to electrodes of said display devices for a predetermined duration of a frame period based on the pixel signal read from said memory device.

5. A flat panel display apparatus according to claim 4, wherein said driver sequentially supplies the drive current to the electrodes of said display devices until the end of said frame period.

6. A flat panel display apparatus according to claim 4, wherein said driver sequentially supplies the drive current to the electrodes of said display devices beyond said frame period to a subsequent frame period.

7. A flat panel display apparatus according to claim 4, wherein at least one of said memory devices is provided in correspondence with each of said display devices.

8. A flat panel display apparatus according to claim 5, wherein at least one of said memory devices is provided in correspondence with each of said display devices.

9. A flat panel display apparatus according to claim 6, wherein at least one of said memory devices is provided in correspondence with each of said display devices.

10. A flat panel display apparatus according to claim 4, wherein one of said drivers is provided in correspondence with each of said display devices and supplies the drive current to the electrode of said display device.

11. A flat panel display apparatus according to claim 4, wherein a plurality of said display devices are allocated to each of said drivers, and each of said drivers sequentially supplies the drive current to said plurality of display devices in a time-division manner.

12. A flat panel display apparatus comprising:

a plurality of display devices forming pixels arranged in a matrix;

a pixel-signal extracting circuit to extract a signal corresponding to a given pixel from a high-frequency image signal;

a plurality of memory device adapted to record, in a time sequential order, a plurality of pixel signals respectively extracted from a plurality of frame images arranged in a time sequential order;

at least one controller having a delay circuit, wherein at least one controller is adapted to receive the extracted pixel signals through the plurality of memory devices and to generate a plurality of read signals at the timing of a change of a pixel signal and wherein the delay circuit is adapted to supply read signals to said plurality of memory devices with a time lag; and a driver to sequentially supply a drive current to electrodes of said display devices based on the pixel signals read from said memory devices.

* * * * *